US006000591A

United States Patent [19]

Alexander

[11] Patent Number: 6,000,591

[45] Date of Patent: Dec. 14, 1999

[54] STRING BEANS TOY HOLDER AND METHOD OF MANUFACTURE

[76] Inventor: Bonnie T. Alexander, 3242 Southwestern Blvd, Dallas, Tex. 75225

[21] Appl. No.: 08/852,634

[22] Filed: May 7, 1997

[51] Int. Cl.[6] ..... A45F 5/00

[52] U.S. Cl. ..... 224/257; 224/250; 224/269; 446/227; 211/113; 294/157; 24/17 B; 24/482; 24/301

[58] Field of Search ..... 224/191, 650, 224/651, 647, 219, 220, 269, 249, 250, 257, 258, 917, 223, 600, 605, 603; 446/227, 28; 24/3.1, 3.12, 3.13, 298, 300, 301, 302, 68 CD, 17 B, 482; 211/13.1, 113, 118, 117; 294/157, 152, 146, 149

[56] References Cited

U.S. PATENT DOCUMENTS

| | | | |
|---|---|---|---|
| 485,922 | 12/1892 | Fleisher | 294/157 |
| 702,398 | 6/1902 | Bowyer | 224/250 |
| 1,521,531 | 12/1924 | Hanold | 224/250 |
| 1,797,098 | 3/1931 | Minehart | 224/269 X |
| 3,085,610 | 4/1963 | Vardan | 446/227 |
| 3,126,860 | 3/1964 | Shepperton | 24/301 |
| 3,184,883 | 5/1965 | McCook | 224/250 |
| 4,654,991 | 4/1987 | Jones | 221/118 |
| 4,749,088 | 6/1988 | Workman et al. | 211/118 |
| 5,109,578 | 5/1992 | Cox | 24/298 |
| 5,370,288 | 12/1994 | Field | 224/223 |
| 5,601,197 | 2/1997 | Baxter | 211/113 |
| 5,622,346 | 4/1997 | Story, Jr. | 224/250 |
| 5,669,170 | 9/1997 | Norris | 224/250 |
| 5,673,464 | 10/1997 | Whittaker | 24/68 CD |
| 5,813,584 | 9/1998 | Mauser | 224/605 |

OTHER PUBLICATIONS

Bean Pole Display (see attached), downloaded from the Internet. No Date Given.

Beanie Belts (see attached), downloaded from the Internet. No Date Given.

Beany–Stalk (see attached), downloaded from the Internet. No Date Given.

*Primary Examiner*—Gregory M. Vidovich

[57] ABSTRACT

A toy carrier and storage apparatus is disclosed for selectively attaching and storing a number of toys. The carrier may be worn over a shoulder or carrier carried by the hand. An extension toy carrier is also disclosed which may be attached to the toy carrier, or to a belt loop, backpack or the like. The toy carriers are provided with a number of carrying loops within which a stuffed, animal shaped or other toy may be inserted and maintained in a visible location for ready access and display.

6 Claims, 2 Drawing Sheets

STRING BEANS TOY HOLDER AND METHOD OF MANUFACTURE

TECHNICAL FIELD

The present invention relates in general to toy carriers and display systems, and in particular to carriers for beanbag, animal shaped toys.

BACKGROUND OF THE INVENTION

Stuffed toys are well known. One popular version of a stuffed toy is marketed under the name "Beanie Babies." This embodiment of a stuffed toy is an animal or other shape formed from a beanbag, or a number of beanbags sewn or attached together. These toys have been successfully marketed and children are known to own several of such toys. Consequently, when the child travels, the child must pack and keep track of his or her numerous stuffed toys, and is prone to losing one or more of them, presenting a disadvantage to the child and to his or her parent who will likely be called upon to provide a replacement. Often, the toys are packed into a backpack or other closed carrier which does not provide ready access. What is needed is a way for a child to assemble all or a few of his or her stuffed toys to prevent loss during travel while leaving the toys accessible for viewing or for ready access. What is also needed is a way for a child and his or her parent to store and display all or a selected few of the stuffed toys in the house.

SUMMARY

These and other needs are addressed by a toy carrier and storage apparatus incorporating the present invention. The carrier and storage apparatus provides a flexible length of material having a plurality of carrying loops attached to a central portion of the material. Stuffed toys are pulled through the loops and can thus be easily carried or stored where desired.

BRIEF DESCRIPTION OF THE DRAWINGS

For a more complete understanding of the present invention and the advantages thereof, reference is now made to the following Detailed Description taken in conjunction with the accompanying Drawings in which.

DETAILED DESCRIPTION

Figure 1:
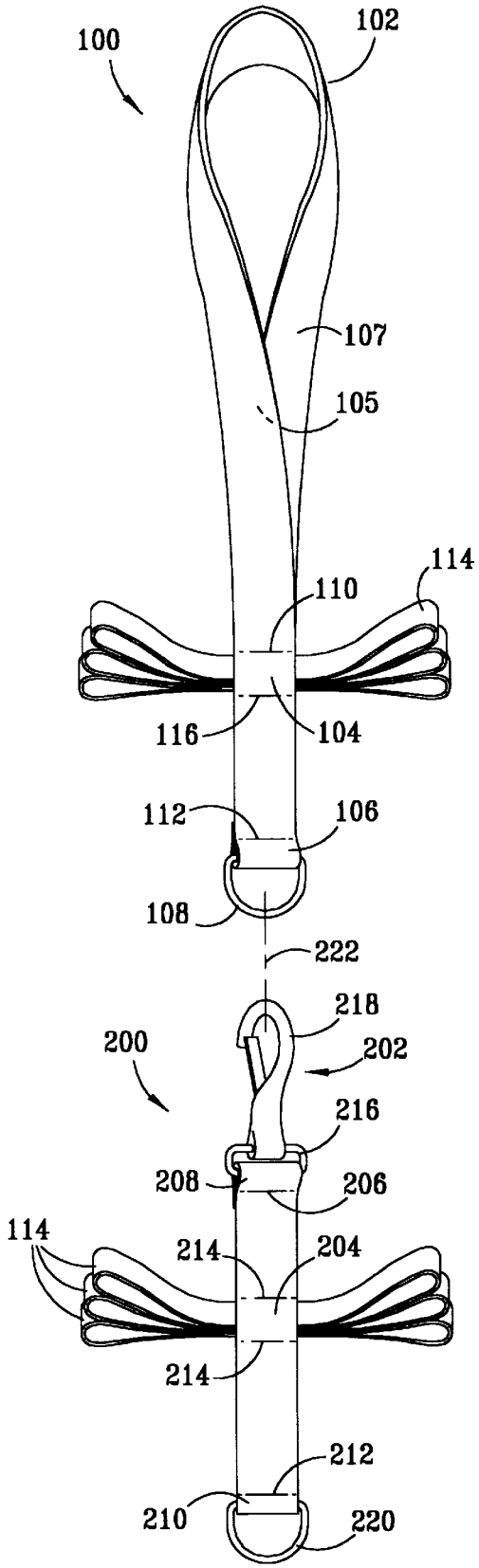
FIG. 1 illustrates a front view of a toy holder and an extension toy holder in accordance with the present invention.

FIG. 1 illustrates a front view of a toy holder 100. Toy holder 100 has an upper loop 102, central portion 104 and lower loop 106. Upper loop 102, central portion 104 and lower loop 106 are preferably formed of nylon webbing, although any flexible material which is capable of being sewn, attached, riveted, fused together or otherwise secured together, such as other plastic-based webbing material or any corded material is suitable and may be used.

In one embodiment of toy holder 100, a 36" length of the webbing having two ends is provided and threaded through a ring 108. In a preferred embodiment the webbing has a width of 1", although wider or narrower widths may be used.

A circular loop is formed by sewing, fusing or otherwise attaching the two ends of the webbing together. Afterwards, two opposing faces 105 and 107 of the loop are brought together face to face and secured at seams 110 and 116 to form central portion 104. An upper loop 102 is also formed by the unsecured portion of the webbing above central portion 104. The upper loop 102 is formed by securing the opposing faces 105 and 107 of central portion 104 to each other at seam 110. Lower loop 106 is defined by securing the two opposing faces 105 and 107 of central portion 104 to each other at seam 112. Ring 108 is carried by lower loop 106. A label (not shown) may be sewn to toy holder 100 to cover central portion 104.

At least one and preferably three carrying loops 114 are sewn together at their mid-section between the two opposing faces 105 and 107 of central portion 104. Both ends of each loop 114 extend outwardly from the webbing. Each separate carrying loop formed by the ends of loop 114 extending from the central portion 104 forms a fastening means capable of holding one or more toys. Carrying loops 114 are preferably formed of ½" wide elastic strapping material, although other widths may also be used.

Figure 3:
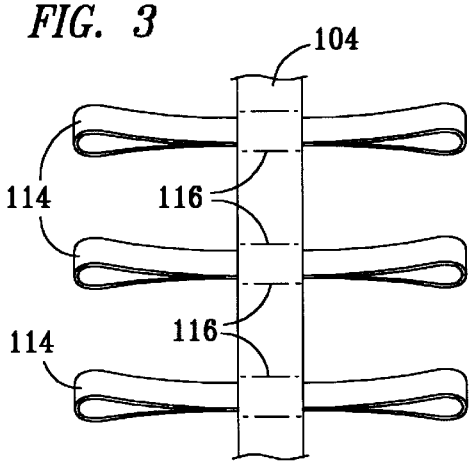
FIG. 3 illustrates an alternative embodiment of the central portion of the toy holder of FIG. 1.

As shown in FIG. 1, carrying loops 114 are preferably aligned when attached to central portion 104. causing carrying loops 114 to overlap along their lengths. Alternatively, the plurality of carrying loops 114 may be skewed out of alignment (not shown) to "fan out," or assume a fan-like shape as they extend from central portion 104. An alternative embodiment is shown in FIG. 3, where a plurality of central portions 104 are established, each with one or more carrying loops 114 sewn at each location and extending from either side of the central associated portion 104.

Other lengths of webbing may also be used to vary the length of toy holder 100. Seams 110, 112 and 116 may be placed at different locations along toy holder 100 in order to vary the size and lengths of upper loop 102, central portion 104 and lower loop 106, as desired.

Figure 2:
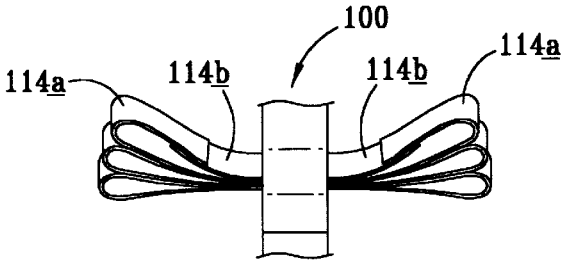
FIG. 2 illustrates a front view of an extension toy holder in accordance with the present invention.
Figure 4:
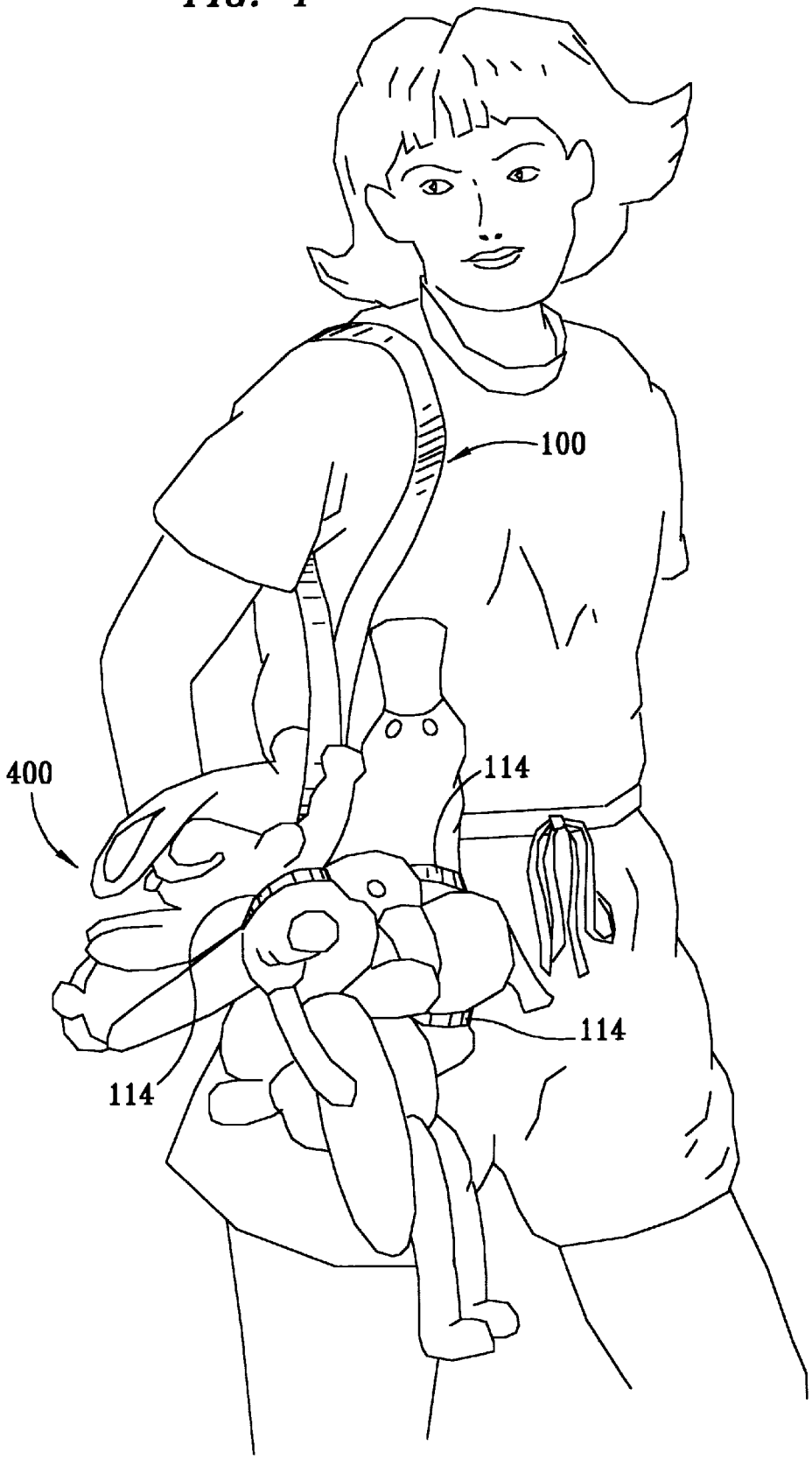
FIG. 4 illustrates the toy holder of FIG. 1 in use.

FIG. 4 illustrates toy holder 100 in use, whereby upper loop 102 serves as a carrying strap or handle which may be worn over the shoulder of the user so that lower loop 106 and ring 108 hangs downward. The ends of carrying loops 114 extending from the webbing of the toy holder 100 are stretched around each toy to hold the toy in place. A number of stuffed toys 400 are inserted into the extending ends of carrying loops 114 so that the toys are held in place until needed. When so configured, the user may carry a number of toys from place to place easily and efficiently without worry that a toy may become lost. This holds the toy (or toys) in a visible location until it is needed, yet allows a child or other user to easily remove the toy by pulling it out of carrying loop 114. It shall be understood that materials other than elastic strapping material may be used to form carrying loops 114. Alternative fastening means may be utilized for securing toys to the toy holder 100; for example, as shown in FIG. 2A, carrying loops 114 may be formed of hook and loop fastening means such as cooperating Velcro® straps, from strings to be tied around the toys to be carried or displayed, or snap hooks may be attached to toy holder 100.

FIG. 1 illustrates a toy holder extension 200. Extension 200 is formed of nylon webbing or the like, similar to toy holder 100. In a preferred embodiment, a 12" length of webbing material having two ends is provided and threaded through ring 220 and snap hook 202. Snap hook 202 has an opening, or eye, 216 through which the webbing may be threaded, and a hook portion 218. A circular loop is formed by sewing, fusing, riveting or otherwise securing the two ends of the webbing together. Afterwards, a central portion 204 is formed by securing the webbing together along seams 214. A loop 210 is formed by a seam 212. Loop 208 is formed by securing the two opposing faces of the webbing to each other at seam 206. Loop 210 is defined by securing the two opposing faces of the webbing to each other at seam 212. Ring 220 is carried by lower loop 210. Snap hook 202 is carried by upper loop 208. A plurality and preferrably at least three carrying loops 114 are sewn or otherwise secured to central portion 204 between seams 214. Carrying loops 114 are preferably formed of ½" wide elastic strapping material, although other widths and materials may also be used. A central portion of each of the carrying loops 114 is secured to the webbing, allowing both ends of each loop 114 to extend outwardly from the webbing edges. Seams 214 are immediately above and below carrying loops 114. As an alternative, 206 and 212 may be deleted, in which case the webbing will be held together by seams 214.

Carrying loops 114 of extension 200 may be attached to central portion 204 in the various alternative manners discussed with respect to loops 114 of toy holder 100 and shown in FIGS. 1 and 3.

Other lengths of webbing may also be used to vary the length of extension 200. Seams 206, 212 and 214 may be placed at different locations along extension toy holder 200 in order to vary the size and lengths of upper loop 208, central portion 204 and lower loop 210.

Extension 200 is capable of carrying or storing a number of toys inserted into carrying loops 114. As examples of use, extension 200 may be used by itself, snapped to a backpack or belt loop, or may be attached to toy holder 100 as an extension, by attaching snap hook 202 to ring 108 of toy holder 100, as is symbolized by broken line 222. The aforementioned rings and snap hooks are linking means for attaching one or more extensions 200 (in series or in parallel) to the toy holder 100. Additional extensions 200 may be attached to ring 108 of toy holder 100. Alternatively, a series of extensions 200 may be strung one to another by attaching snap hook 202 to ring 220 of another extension 200. In an alternative embodiment, ring 220 may be deleted from extension 200. In this embodiment, a member of extensions 200 could not be strung one to another, however, a number of extensions 200 could be attached to ring 108 of toy holder I 00. In yet another embodiment, the ring 108 of toy holder 100 could be replaced by yet another snap hook 202.

While the present invention and its advantages have been described in detail, it should be understood that various changes, substitutions and alterations can be made herein without departing from the scope and spirit of the invention as defined by the appended claims.

What is claimed is:

1. A method of manufacturing a toy carrier, comprising the steps of:

providing a length of flexible material;

attaching the ends of the length of material to each other to form a loop;

bringing together two segments of the loop to form a central portion;

attaching the two segments to each other at an upper point to define an upper loop and at a lower point to define a lower loop, the length of material between the upper point and the lower point defining the central portion;

attaching a plurality of carrying loops to the central portion; and positioning at least one toy in at least one of the carrying loops.

2. The method of claim 1 wherein the carrying loops are elastic.

3. The method of claim 2, wherein the upper loop, the central portion and the lower loop are formed of nylon webbing.

4. The method of claim 1 wherein the length of flexible material is a first length of flexible material, and wherein the method further comprises securing a linking means to the first length of flexible material for attaching a second length of flexible material thereto configured for increasing the capacity of the toy carrier for holding toys.

5. The method of claim 1 wherein the length of flexible material is a first length of flexible material, and wherein the method further comprises securing a substantially closed-loop ring to the first length of flexible material for attaching a second length of flexible material thereto configured for increasing the capacity of the toy carrier.

6. The method of claim 1 wherein the flexible material is a first length of flexible material, and wherein the method further comprises:

detachably linking a second length of flexible material to the first length of flexible material; and securing a plurality of elastic fastening means to the second length of flexible material such that the plurality of elastic fastening means extends from the second length of flexible material for holding and securing additional toys.

* * * * *